United States Patent [19]

Rhodes et al.

[11] 4,360,793

[45] Nov. 23, 1982

[54] EXTRACTED POLE FILTER

[76] Inventors: John D. Rhodes, Boodels, Thorpe La., Tranmere Park, Guiseley, Leeds, England, LS20 - 8JH; Richard J. Cameron, Gerberahof 27, 2201 E - Noordwijk, Netherlands

[21] Appl. No.: 250,115

[22] Filed: Apr. 2, 1981

[51] Int. Cl.[3] ..... H01P 1/208; H01P 1/209

[52] U.S. Cl. ..... 333/212; 333/209

[58] Field of Search ..... 333/209-212, 333/206-208, 157, 248

[56] References Cited

U.S. PATENT DOCUMENTS 3,737,816 6/1973 Honicke ..... 333/209 X

OTHER PUBLICATIONS

Rhodes—"The Generalized Direct-Coupled Cavity Linear Phase Filter", IEEE Transactions on Microwave Theory and Techniques, vol. MTT-18, No. 6, Jun. 1970, pp. 308-313.

*Primary Examiner*—Marvin L. Nussbaum

*Attorney, Agent, or Firm*—Fred A. Keire

[57] ABSTRACT

An electric transmission structure for implementing a transfer function with finite real-frequency transmission zeros, which comprises a main body comprised of a plurality of resonant cavities placed adjacent to each other with inductive coupling irises between adjacent cavities, the resonant cavities being arranged symmetrically relative to a plane of conjugate symmetry, said main body synthesizing the linear phase part of the filter transfer function, and at least one pair of pole resonant cavities arranged symmetrically relative to said plane of conjugate symmetry, each of said resonant cavity pairs synthesizing a pair of finite real-frequency transmission zeros of the filter transfer function, with the respective pole cavities of each pair being connected across the input and output ends of the main body through phase-shift waveguides having defined phase-shift lengths.

3 Claims, 7 Drawing Figures

EXTRACTED POLE FILTER

BACKGROUND OF THE INVENTION

The present invention relates to a new structure for high-power, low-loss microwave filters and a synthesis technique to implement same in a waveguide realization.

When considering a band-pass filter specification, the first steps that must be taken involve the generation of a filtering function. This is a purely mathematical process, the inputs to which include such parameters as out-of-band rejection corner points, inband group delay flatness etc which are normally supplied with the specification. The outcome is usually a ratio of two finite-degree polynomials, the evaluation of which yield rejection/-return loss/group delay vs frequency curves which fit the specification.

The next step is to convert the purely mathematical filtering function into a low-pass prototype network of electrical elements such as capacitors and transmission lines, the electrical analysis of which will show characteristics equal to those resultant from the mathematical evaluation of the filtering function. The configuration of the network is arranged in a manner so that each element of the network corresponds with the equivalent element of the structure that will eventually be constructed to realize the filtering function. For microwave band-pass filters the configuration and topology of this low-pass network are important because mechanical constraints severely limit the variety of networks that can be realized with the cavities and irises of a microwave filter. FIG. 1 shows an 8th degree example of the most commonly used type of prototype network known as the cross-coupled double array and FIG. 2 shows an equivalent rectangular waveguide structure known as the folded configuration as it would be realized in accordance with the prior art.

The waveguide structure of FIG. 2 consists of two identical conventional direct-coupled 4-cavity filters with shunt reactive irises K between adjacent cavities, cross-coupled by small apertures K′ in the common narrow wall. The shunt capacitors $C_1$, $C_2 \ldots C_8$ in FIG. 1 are realized in the electrical lengths of the cavities. If these waveguide elements are correctly dimensioned according to the values of their corresponding parameters in the low-pass network of FIG. 1, the waveguide structure will yield an electrical performance very similar to that embodied within the original filtering function.

With the increase in capacity and complexity of satellite telecommunication and broadcast repeaters over the past decade, the degree of linearity and selectivity specified for the filters within the repeaters has tightened considerably. In addition, as the RF power amplifiers become more powerful (particularly in TV broadcast missions), the insertion loss of the output multiplexer filters has to be minimized. In order to meet these requirements of linearity and selectivity specialized filtering functions have been developed, most commonly pseudo- and canonic elliptic functions. Each of these function types offers considerable advantages in terms of reductions in signal distortion, adjacent channel interference and insertion loss. Referring particularly to the networks of FIGS. 1 and 2, these specialized functions are realized with the cross-couplings K′ which may be positive, zero or negative depending on the type of filtering function employed. In general the forward couplings K are positive and never zero. For purely linear-phase filters, the cross-couplings K′ are either positive or zero, but for elliptic or combined linear-phase/elliptic types the cross-couplings K′ become mixed-sign. The realization of the mixed-sign cross-coupling in waveguide is not a problem if the $TE_{10}$ mode resonance in rectangular or square waveguide, or the $TE_{11}$ mode in cylindrical guide are employed. With judicious placement of the cross-coupling irises in the rectangular or square waveguide structure, or using dual-moding techniques within the $TE_{11}$ mode cylindrical cavity, all the specialized filtering functions mentioned above may be realized. However it was also mentioned above that with high power channels it is essential to minimize the loss of output multiplexer filters since failure to do so would result in cooling problems and have consequences in weight, reliability and signal distortion. For input filters, particularly those that combine channels before amplification, low loss is essential to minimize system noise figure.

With these points in mind it becomes advantageous to use the high Q (that is low-loss) $TE_{01}$ mode cylindrical cavity resonance. Implicit in the high Q property is a lage cavity volume which renders construction easier at millimeter wave frequencies and a lower sensivity to manufacturing tolerances. A filter constructed using the $TE_{01}$ cavity suffers from two major problems:

(a) negative couplings are only achievable with a complicated three-dimensional configuration; and (b) the $TE_{01}$ resonance is a higher order resonance and degenerate with it is the unwanted $TM_{11}$ resonance.

The first attempt to construct an elliptic function filter was by Atia and Williams of Comsat Laboratories in 1976. They achieved the mixed-sign couplings with a complicated two-layer mechanical arrangement, and then "suppressed" the degenerate mode with dielectric cubes inside the cavity (actually these cubes shifted the frequency of the degenerate mode out of the filter's passband). The introduction of such dielectrics inevitably increases the loss of the cavity thereby eliminating the chief reason for using the solution. This is the only case known to the applicants of an attempt made to realize a filtering function with $TE_{01}$ cavities.

The problems discussed above have been solved by the present invention which provides a new approach.

SUMMARY OF THE INVENTION

The invention has as main object a new structure for cavity filters assuring a low-loss, low-distortion filtering function.

Another object of this invention is a new cavity arrangement for a low-loss $TE_{01}$ mode filter of simple and robust construction.

Yet another object of the invention is a synthesis technique for implementing the filter structure of the invention in simple and robust waveguide realization, suitable for narrow band filtering in the 10–40 GHz range.

According to the invention there is provided an electric transmission structure for implementing a transfer function with finite real-frequency transmission zeros, which comprises a main body comprised of a plurality of resonant cavities placed adjacent to each other with inductive coupling irises between adjacent cavities, the resonant cavities being arranged symmetrically relative to a plane of conjugate symmetry, said main body synthesizing the linear phase part of the filter transfer function; and at least one pair of pole resonant cavities arranged symmetrically relative to said plane of conjugate symmetry, each of said resonant cavity pairs synthesizing a pair of finite real-frequency transmission zeros of the filter transfer function, with the respective pole cavities of each pair being connected across the input and output ends of the main body through phase-shift waveguides having defined phase-shift lengths.

The structure according to the invention has the advantage of allowing the filter to be made in a simple, compact and robust construction with dimensions large enough to ensure a large RF power handling capability (estimate several kilowatts), increased immunity from multipactor effect in space and reduced sensitivity to manufacturing dimensional tolerances. This construction also allows large volume cavities to be used, which ensures optimally low insertion loss at high frequency. A further advantage of the filter structure according to this invention is that fine adjustment of all elements is possible by tuning screws, which allows tuning of each cavity separately for providing optimal performance. Also the tuning procedure is greatly simplified for the pole cavities can be tuned separately without affecting the other elements. This feature allows for some interesting singlesided derivatives which may find application in contiguous-channel diplexers.

Applications of the extracted pole filter structure in accordance with this invention are particularly promising in the field of high-power low-loss output multiplexing. One application which is to be noted in particular is in the output diplexer of L-SAT's TV broadcast mission and in the output stages of the ultra-narrowband specialized services mission where all other technologies would be far too lossy. Another promising widespread application is in the output multiplexers of high-power earth stations ranging in frequency from X band to Q band.

Figure 3:
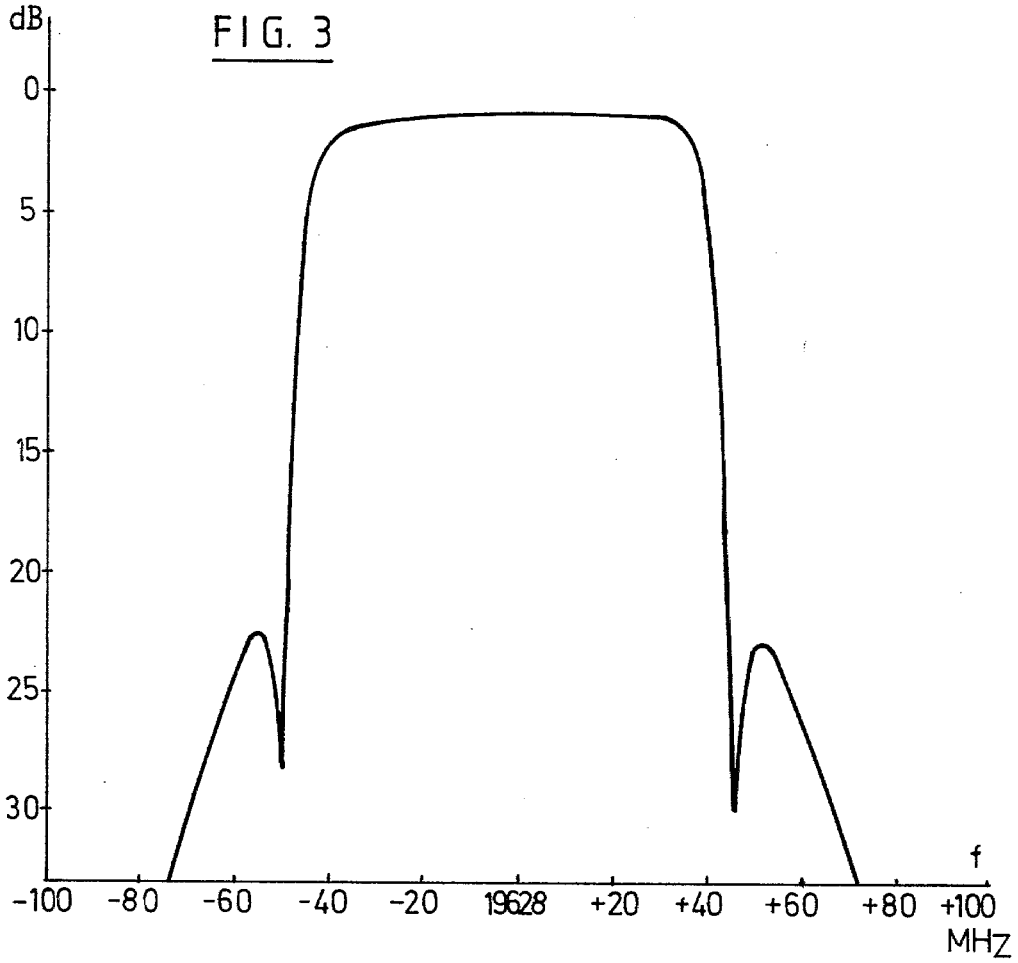
FIG. 3 shows an exemplary insertion loss characteristic curve.

The basic synthesis technique is to separate from the main body structure of the filter those elements which realize the finite transmission zeros or poles of the filter transfer function to be achieved, so that the main body merely realizes the linear phase part of the transfer function. As is known, the main body of the filter may then be implemented in the form of a symmetrical double array of cross-coupled cavities where the couplings are all of one sign. Before reviewing the synthesis procedure to be applied in order to synthesize the structure of the invention, reference is made to FIG. 3 which shows an exemplary insertion loss characteristic curve vs frequency and to FIG. 4 which shows an exemplary embodiment in accordance with the invention for realizing the characteristic curve of FIG. 3.

Figure 1:
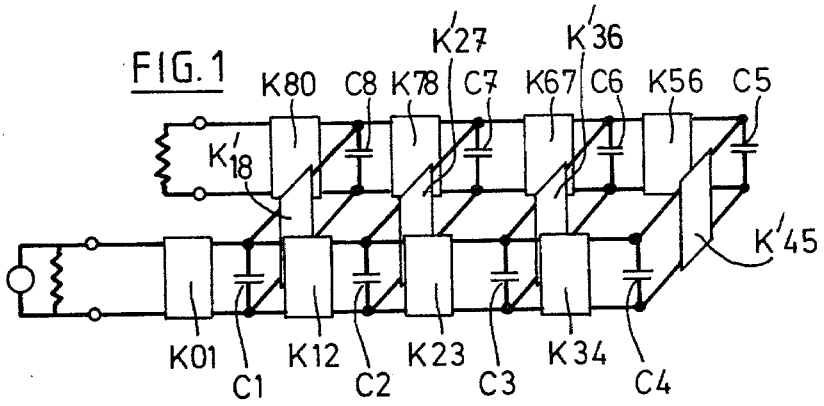
FIG. 1 illustrates an example of a known filter prototype network.
Figure 2:
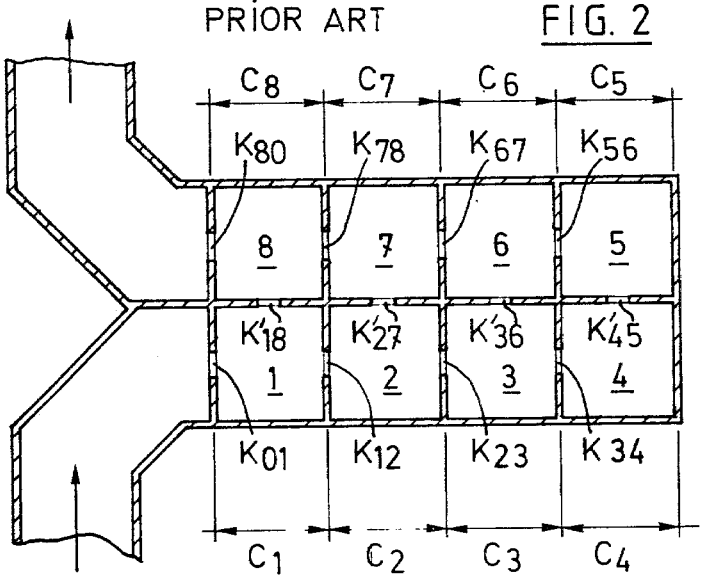
PRIOR ART FIG. 2
FIG. 2 depicts schematically a prior art waveguide structure which is equivalent to the prototype network of FIG. 1.
Figure 4:
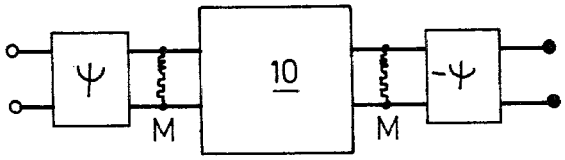
FIG. 4 is a schematic diagram illustrating the pole extraction procedure according to the invention.
Figure 5:
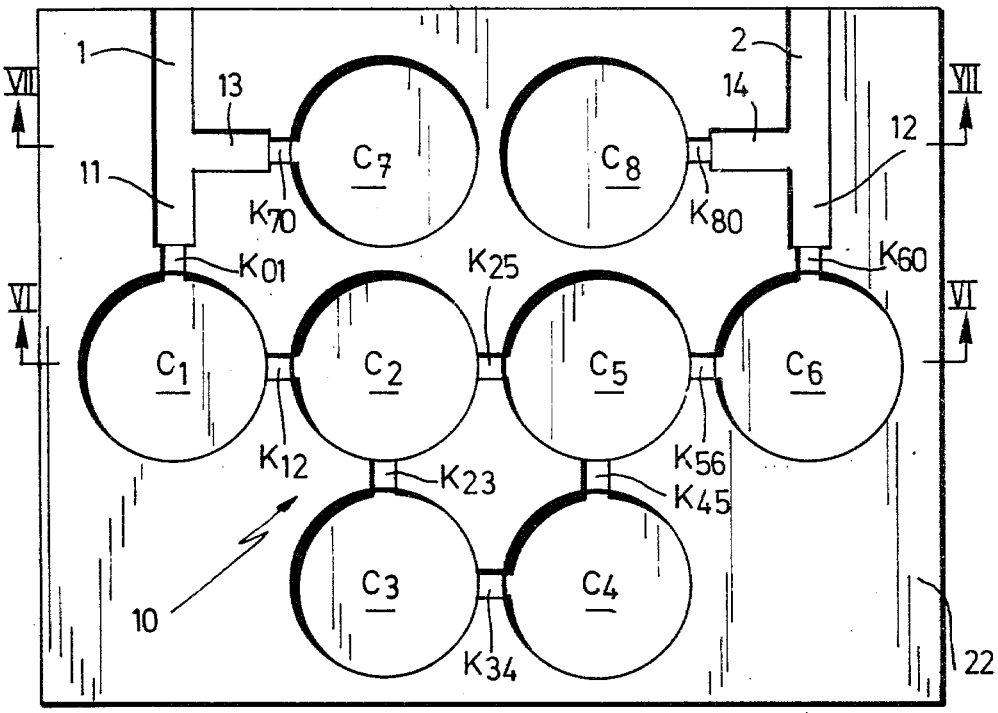
FIG. 5 is a plan view of an exemplary waveguide realization in accordance with the invention.

The characteristic curve illustrated in FIG. 2 possesses a pair of finite real frequency transmission zeros or poles on either side of the 82 MHz passband centered on 19.628 GHz. Another pair of poles are at infinity. According to the invention, the pair of finite poles are realized independently by structure elements separate from the main body of the filter which in turn realizes the linear part of the characteristic curve. Referring to FIG. 4, the main body of the filter is denoted 10 and the separate pole elements comprise the shunt reactances $M_1$, $M_2$ connected across the input and output of the main body 10 by phase shifters 11,12. As it is well known in the art, the shunt reactances can be realized as resonators of defined admittances and electrical lengths and the phase shifts can be realized as phase lengths of waveguide. FIG. 5 is a plan sectional view showing an exemplary embodiment in an 8th degree pseudoelliptic/linear phase filter implementation. Numerals 1 and 2 denote the input and output transmission lines of the filter. The main body 10 is comprised of six cross-coupled resonant cavities $C_1$–$C_6$ arranged symmetrically relative to a plane of conjugate symmetry S. The cross-couplings between the cavities $C_1$–$C_6$ are all positive, that is they are made by shunt inductive irises $K_{12}$, $K_{23}$, $K_{34}$, $K_{45}$ and $K_{56}$. The pair of extracted pole cavities $C_7$ and $C_8$, which also are symmetrically arranged relative to the symmetry plane S, are shunt-coupled into the input and output transmission lines 1 and 2 with couplings $K_{70}$, $K_{01}$, $K_{60}$ and $K_{80}$ of the same sign as those within the main body 10, that is with inductive irises. Preferably, in accordance with the invention the irises in the body 10 are arranged such that the respective axes of consecutive irises along the signal main path are at right angles to each other, thereby to ensuring that the degenerate transmission $TM_{11}$ mode resonance will not propagate through said filter body. The coupling iris $K_{25}$ is provided to get flat group delay.

Synthesizing the filter structure of this invention is carried out along a synthesis procedure which is comprised of two parts: an initial extraction part to design the extracted pole prototype network and a synthesis part to convert the prototype network into one which is suitable for realization in waveguide. The initial part of the synthesis procedure is developed in terms of the transfer function matrix of the filter network and includes different extraction cycles in order to extract each pair of finite poles, each cycle comprising the steps of determining the phase lengths of the unity impedance phase shifters and of determining the susceptances and electrical lengths of the extracted shunt resonators. These steps are repeated until either all or the desired number of poles have been extracted. The remaining linear phase part of the filter transfer function is then realized by the main body 10 of the filter in the form of a cross-coupled double array, known per se. The mathematical derivations for the extraction procedure are developed in an article entitled "General Extracted Pole Synthesis Technique with Applications to Low-loss $TE_{011}$ Mode Filters" by J. David Rhodes and Richard J. Cameron, published in IEEE, Vol. MTT-28, No. 9, September 1980.

Having thus designed the extracted pole prototype network, the synthesis procedure develops further in order to convert the prototype network into the equivalent waveguide structure arrangement according to the invention. The conversion procedure is comprised of three stages: synthesis of the cross-coupled body of the filter, synthesis of the extracted pole cavities and finally determination of the phase lengths between the pole cavities and the main body of the filter.

The synthesis of the main body 10 is described by J. D. Rhodes in "The Generalised Direct-coupled Cavity Linear Phase Filter", IEEE, MTT-18, June 1970. The mathematical derivations will not be repeated here.

The extracted pole cavities (e.g. $C_7$–$C_8$ in FIG. 5) are synthesized using the constructional mathematical relations (41) in the reference by J. David Rhodes and Richard J. Cameron mentioned earlier herein.

The phase lengths between the pole cavities and the main filter body are determined as indicated in the above mentioned reference, using relation (42).

The parameters in the structure which have to be determined are the iris susceptances, the electrical lengths of the cavities and the phase lengths between the pole cavities $C_7$–$C_8$ and the main body 10.

The lengths of waveguide between the pole cavities $C_7$–$C_8$ and the filter body 10 have to accommodate the phase lengths $\psi$ the short negative length of transmission line associated with the input and output susceptances $K_{01}$, $K_{60}$ of the filter body, and the admittances associated with the equivalent circuit of the pole cavities.

To compensate for the short negative lengths of the transmission line associated with the iris susceptances of the pole cavities $C_7$–$C_8$, lengths of waveguide (e.g. 13, 14) are included between the pole cavity irises (e.g. $K_{70}$, $K_{80}$) and the main waveguides (e.g. 11, 12).

Figure 7:
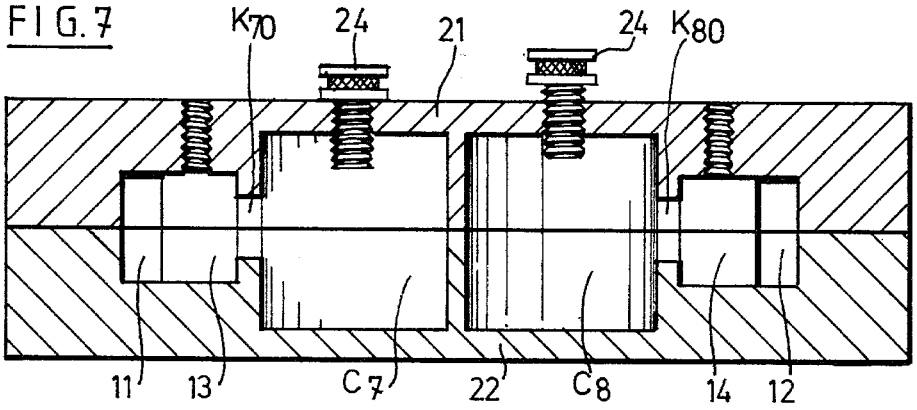
FIG. 7 is a sectional view along line VII—VII in FIG. 5.
Figure 6:
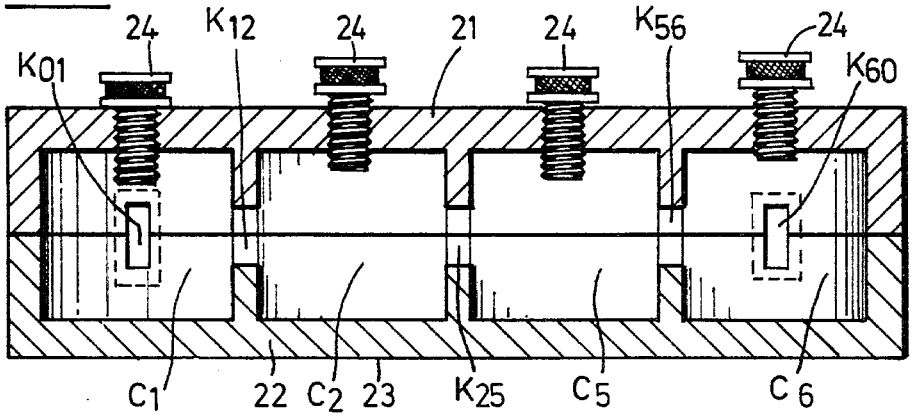
FIG. 6 is a sectional view along line VI—VI in FIG. 5.

The filter structure with single-sign couplings which results from the synthesis procedure of this invention permits the structure to be implemented in a simple and compact construction with a flat bottom as depicted in FIGS. 6 and 7. The structure is formed in two solid blocks of aluminium 21–22 in each of which are milled one half of each cavity and one half of each coupling iris and transmission line. The flat bottom 23 ensures best dissipation of heat to a flat cooling plate. This construction has the advantage of allowing the filter to be made with dimensions large enough to ensure a large RF power handling capability (estimate several kilowatts), increased immunity from multipactor effect in space and reduced sensitivity to manufacturing dimensional tolerances. Further, this construction allows large volume cavities to be used, which ensures optimally low insertion loss at high frequency.

A further advantage of the filter structure according to this invention is that fine adjustment of all elements is possible by tuning screws, which allows tuning of each cavity separately for providing optimal performance. Threaded apertures are provided in the end wall of the resonant cavities for accommodating tuning screws as shown at 24 on FIGS. 6 and 7. Also the tuning procedure is greatly simplified for the pole cavities can be tuned separately without affecting the other elements. This feature allows for some interesting applications as noted earlier herein.

The resonant cavities of the two halves of the body network (e.g. $C_1$, $C_2$, $C_3$, and $C_6$, $C_5$, $C_4$ respectively) are complex-conjugately tuned and slightly different in length. In practice, the length difference between corresponding cavities in the two halves of the network is small and can be totally taken up by the tuning screws.

What is claimed is:

1. An electric transmission structure for implementing a transfer function with finite real-frequency transmission zeros, said structure comprising:

a main body (10) comprised of a plurality of resonant cavities ($C_1$–$C_6$) placed adjacent to each other with inductive coupling irises (e.g. $K_{12}$, $K_{23}$, . . . ) between adjacent cavities, said resonant cavities being arranged symmetrically relative to a plane of conjugate symmetry (S), said main body synthesizing the linear phase part of the filter transfer function; and at least one pair of pole resonant cavities ($C_7$, $C_8$) arranged symmetrically relative to said plane of conjugate symmetry, each resonant cavity pair synthesizing a pair of finite real-frequency transmission zeros of the filter transfer function, the respective pole resonant cavities of said at least one pair of pole resonant cavities being connected across the input and output ends of the main body (10) through phase-shift waveguides (11, 12) having defined phase-shift lengths.

2. A filter structure according to claim 1, wherein the pole cavities ($C_7$, $C_8$) are connected to the phase-shift waveguides (11, 12) by short waveguides (13, 14).

3. A filter structure according to claim 1, wherein the consecutive coupling irises (e.g. $K_{12}$, $K_{23}$, . . . ) in said main body (10) have their respective axes at right angle to each other.

* * * * *